US007361233B2

(12) United States Patent
Budinger et al.

(10) Patent No.: US 7,361,233 B2
(45) Date of Patent: Apr. 22, 2008

(54) METHODS OF HYDROGEN CLEANING OF METALLIC SURFACES

(75) Inventors: David Edwin Budinger, Loveland, OH (US); Ronald Lance Galley, Mason, OH (US); Mark Dean Pezzutti, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 586 days.

(21) Appl. No.: 10/731,115

(22) Filed: Dec. 10, 2003

(65) Prior Publication Data

US 2005/0126593 A1 Jun. 16, 2005

(51) Int. Cl.
*B08B 5/00* (2006.01)

(52) U.S. Cl. ..... 134/19; 134/4; 134/21; 134/22.1; 134/31; 134/37; 134/62

(58) Field of Classification Search ..... 134/4, 134/19, 21, 22.1, 31, 37, 42, 62
See application file for complete search history.

(56) References Cited

U.S. PATENT DOCUMENTS 3,226,102 A * 12/1965 Pagonis ..... 164/513
4,452,642 A * 6/1984 Dietz et al. ..... 134/1
4,537,761 A * 8/1985 Reed et al. ..... 423/644
5,403,434 A * 4/1995 Moslehi ..... 134/1.2
5,505,794 A * 4/1996 Nakayama et al. ..... 148/508
5,549,767 A * 8/1996 Pietruska et al. ..... 148/512
5,673,562 A * 10/1997 Friedt ..... 62/48.1
5,916,518 A * 6/1999 Chesnes ..... 420/438
6,042,898 A * 3/2000 Burns et al. ..... 427/534
2004/0261923 A1* 12/2004 Burns et al. ..... 148/712

FOREIGN PATENT DOCUMENTS

EP 1491643 A2 * 12/2004

* cited by examiner

*Primary Examiner*—Sharidan Carrillo
(74) *Attorney, Agent, or Firm*—Nixon & Vanderhye, PC

(57) ABSTRACT

The pulsed partial pressure hydrogen cleaning of cobalt-based alloys in turbine components is achieved by disposing the component within a vacuum furnace and heating the component. Upon heating to about 1400° F., a partial pressure hydrogen gas and a vacuum are repetitively cycled within the furnace by supplying in each cycle a fresh supply of hydrogen gas, followed by removal of reaction products between the hydrogen gas and surface contaminants and substantially all residual hydrogen gas from within the furnace. The repetitious cycling renders the surfaces clean, enabling refurbishment thereof by activated diffusion healing repair.

22 Claims, 1 Drawing Sheet

METHODS OF HYDROGEN CLEANING OF METALLIC SURFACES

BACKGROUND OF THE INVENTION

The present invention relates to methods for cleaning metallic surfaces using pulsed hydrogen in a vacuum furnace and particularly relates to methods for cleaning the surfaces of turbine components formed of metallic materials, particularly and for example, cobalt-based alloys, stainless steel and mild steels.

Metallic components, for example, turbine components, particularly turbine nozzles formed of cobalt alloys, develop surface contaminants including surface oxides and surface cracks during usage over time and require refurbishing. Before being refurbished, however, the component surfaces must be cleaned to eliminate the contaminants, e.g., surface oxides including oxidation within the cracks which inhibits the repair of cracks and surface distress. Surface oxides in particular prevent the flow of a fresh material, e.g., a filler of activated diffusion healing (ADH) material, at elevated temperatures due to high surface tension. ADH is a hybrid brazing process that relies on the melting and flow of metal-based material into service-induced cracks or onto surfaces that are being dimensionally reestablished. The success of the ADH repair is dependent upon the ability to adequately clean and/or remove the surface contaminants, including oxides.

The metallic surfaces can, of course, be mechanically cleaned, for example, by wire brushing or local burring with carbide cutting tools. Those methods, however, are low-productivity methods requiring substantial manual labor. To improve productivity, a vacuum furnace or retort using hydrogen gas for cleaning the surfaces has been used. Particularly, hydrogen gas, either in a vacuum furnace (partial pressure atmosphere) or in a furnace retort (at atmospheric or slight positive pressure) has been used to clean surface contaminants and oxides from turbine components including those formed of cobalt-based alloys. When using hydrogen gas to clean such surfaces, a chemical reaction occurs at elevated temperatures within the furnace where the hydrogen reacts with the surface oxides or contaminants to form stable compounds or gases that are subsequently removed. Particularly, when using a partial pressure hydrogen vacuum furnace, the typical approach has been to introduce hydrogen gas into the chamber at a specified temperature and maintain a substantially constant pressure on the order of about 500-10000 microns. In the atmospheric or slight positive pressure approach, a constant flow of hydrogen gas through a retort is maintained and held at temperature. Both of these prior methods, however, do not provide dynamic hydrogen gas flow into tight cracks and the hydrogen gas becomes depleted over time, resulting in no further reduction of oxides. As a consequence, the metallic surfaces are not sufficiently cleaned, which thereby inhibits the adherence of a fresh filler of molten metal e.g., using the ADH process.

BRIEF DESCRIPTION OF THE INVENTION

In accordance with a preferred aspect of the present invention, the metallic surfaces, for example, the surfaces of turbine components formed of cobalt-based alloys, stainless steels or mild steels, are cleaned using pulsed hydrogen gas. Particularly, the heated component(s) disposed in a vacuum furnace is subjected at temperature to repetitive cycling of a hydrogen gas and a vacuum within the vacuum furnace by supplying in each cycle a fresh supply of hydrogen gas within the furnace, followed by a vacuum. In each cycle, the vacuum removes reaction products between the hydrogen gas and the surface components and any residual hydrogen gas from within the vacuum furnace. The repetitive cycling or pulsing of the hydrogen atmosphere enables multiple successive evacuation of the reaction products that form between the hydrogen gas and surface oxides/contaminants, particularly in the surface cracks, and also enables a fresh supply of hydrogen to be reintroduced to the surfaces and particularly the tight crack surfaces of the component. This reintroduction of hydrogen gas allows the chemical reaction to proceed with fresh activation in regions that have previously been evacuated and are difficult to access and maintain contact with fresh hydrogen gas.

In particular preferred embodiments hereof, the partial hydrogen gas and a vacuum are cycled repetitively between a range of about 500-10000 microns, preferably 6000-9000 microns and less than 50 microns, preferably one micron or below, respectively. The temperature of the component is preferably in excess of 1800° F. and, more preferably, at about 2200° F. during the application of the hydrogen gas. The partial hydrogen gas is maintained in the furnace during each cycle for a predetermined period, e.g., 10 minutes to 4 hours, preferably 30 minutes to one hour, while the vacuum of one micron or less is held over a lesser time interval, e.g., for a half-hour or less. A sufficient number of cycles are provided to ensure complete cleaning of the surface. Once cleaned, the repair process, e.g., an ADH process, can proceed with assurance of adherence of the fresh filler to the cleaned surface.

In a preferred embodiment according to the present invention, there is provided a method of cleaning surfaces and surface cracks on a metallic article, comprising the steps of (a) disposing the article within a vacuum furnace, (b) heating the article within the vacuum furnace and (c) repetitively cycling hydrogen gas and a vacuum within the furnace by supplying in each cycle a fresh supply of hydrogen gas within the furnace followed by removal of reaction products between hydrogen gas and surface contaminants and substantially all residual hydrogen gas from within the furnace.

In a further preferred embodiment according to the present invention, there is provided a method of refurbishing surfaces on a turbine component formed of a cobalt-based alloy wherein the surfaces include oxide contaminants, comprising the steps of (a) disposing the turbine component within a vacuum furnace, (b) heating the turbine component within the vacuum furnace, (c) repetitively cycling hydrogen gas and a vacuum within the furnace by supplying in each cycle a fresh supply of hydrogen gas within the furnace, followed by removal of reaction products between the hydrogen gas and surface oxides and substantially all of any residual hydrogen gas from within the furnace and (d) adhering a molten metal to the cleaned surface of the turbine component subsequent to step (c) to refurbish the surface.

In a further preferred embodiment according to the present invention, there is provided a method of cleaning surfaces and surface cracks on a metallic article, comprising the steps of (a) disposing the article in a vacuum furnace, (b) evacuating the furnace, (c) heating the component in the vacuum furnace, (d) in a first cycle, introducing hydrogen gas into the furnace to introduce a partial pressure within the furnace, (e) raising the temperature of the article within the furnace to a predetermined temperature during the first cycle, (f) holding the predetermined temperature of the article within the furnace for a predetermined time period during the first cycle, (g) evacuating the furnace during the first cycle, (h) in a second cycle following the first cycle, reintroducing hydrogen gas into the furnace to obtain a partial pressure within the furnace, (i) raising the temperature of the article within the furnace to a predetermined temperature during the second cycle, (j) holding the predetermined temperature of the article within the furnace for a predetermined time period during the second cycle and (k) evacuating the furnace during the second cycle.

DETAILED DESCRIPTION OF THE INVENTION

Figure 1:
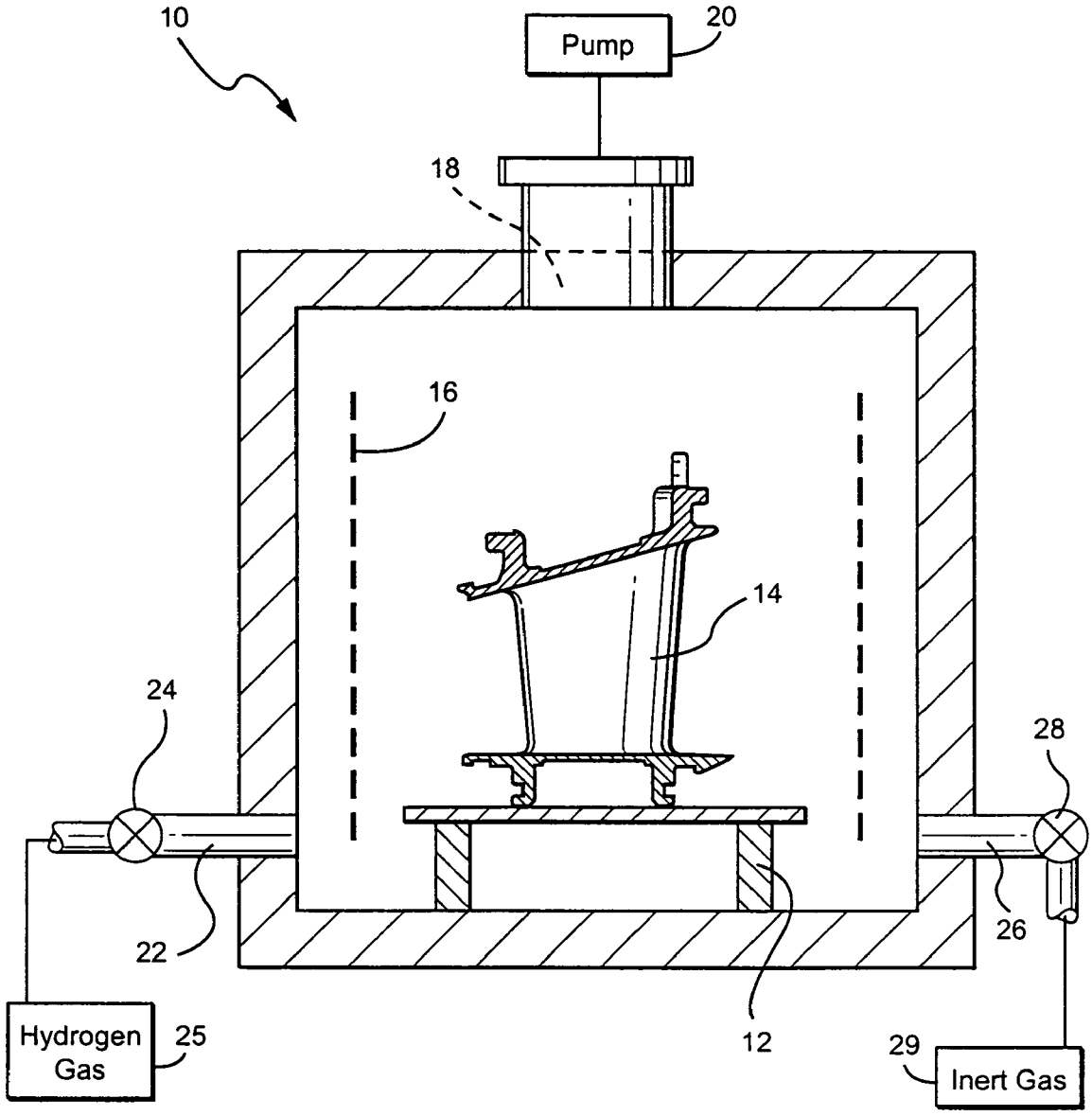
FIG. 1 is a schematic illustration of an example of a vacuum furnace useful for performing the pulsed hydrogen gas/vacuum cleaning methods of the present invention.

Referring to the drawing FIGURE, there is illustrated a vacuum furnace, generally designated 10, including a support 12 for the article or component 14 which is to be cleaned. In this instance, a nozzle 14 for a gas turbine is illustrated on support 12. The component is formed of a metallic material and the cleaning process hereof is particularly applicable to components formed of a cobalt-based alloy, stainless steel or mild steel, such as nozzle 14. It will be appreciated that the component 14 to be cleaned has been in service and may have surface contaminants including oxides and/or surface cracks. Those surfaces require cleaning before a refurbishing process can go forward, e.g., before an ADH process can be employed to repair or refurbish the surfaces.

The vacuum furnace 10 includes a plurality of radiant heating elements 16 for radiantly heating the component(s), e.g., the nozzle 14 disposed within the vacuum furnace. The vacuum furnace 10 also includes an outlet 18 attached to a vacuum pump 20 whereby the vacuum furnace 10 can be evacuated. Additionally, a hydrogen gas inlet 22 is provided. Suitable pumps, not shown, and a valve 24 are also provided for supplying hydrogen gas from a suitable source 25 selectively to the interior of the vacuum furnace 10 at predetermined intervals as set forth below. Further, an inert gas inlet 26 is also coupled to a pump, not shown, and a valve 28 are provided for supplying inert gas from an inert gas supply 29 into the vacuum furnace at the conclusion of the cleaning process. It will be appreciated that the vacuum furnace 10 depicted in the drawing FIGURE is highly representational and for illustrative purposes only. Any suitable vacuum furnace may be provided and/or adapted for purposes of performing methods of cleaning according to a preferred embodiment of the present invention, which will now be described.

In order to clean the surfaces of the component 14 by removing its surface contaminants, including surface oxides, the component 14 is placed within the vacuum furnace 10. The furnace is then evacuated by operation of the vacuum pump 20 and preferably to a vacuum level of about one micron or less. Upon achieving the vacuum, the heating elements 16 are activated to radiantly heat the component 14 within the chamber to a temperature of about 1400° F. Upon obtaining this elevated temperature, hydrogen gas is introduced into the vacuum furnace 10 by operation of hydrogen gas inlet 22 and valve 24. A partial hydrogen gas pressure is thus provided within the chamber of preferably about 6000-9000 microns. Upon achieving this partial pressure, the temperature of the component is elevated within the vacuum furnace 10 in excess of 1800° F. and preferably to about 2200° F. Once this partial hydrogen gas pressure and temperature are achieved, the hydrogen atmosphere at that pressure and temperature is maintained or held for a predetermined time period, for example, 10 minutes to 4 hours, preferably 30 minutes to one hour. It will be appreciated that the hydrogen gas held at temperature in the vacuum furnace reacts with the surface contaminants, particularly the oxides, to form reaction products.

The hydrogen atmosphere within the furnace 10 is then evacuated and a vacuum level of preferably one micron or less is obtained and held for a predetermined time period, for example, one half-hour or less. It will be appreciated that the evacuation of the vacuum furnace chamber removes the reaction products from the furnace, as well as any residual hydrogen gas. Subsequent to achieving this vacuum level and holding that level over the predetermined time, hydrogen gas is then once again introduced into the furnace, similarly as previously described. That is, fresh hydrogen gas is introduced to once again achieve a partial pressure of about 6000-9000 microns, the temperature of the nozzles 14 within the furnace being maintained at 1400° F. or above. The hydrogen pressure is held in the chamber again for a period of preferably approximately 0.5 to one hour. Thereafter, the hydrogen gas including the reaction products are evacuated from the furnace and the furnace obtains a vacuum level once again of preferably one micron or less.

This repetitive pulsing or cycling of the hydrogen gas and vacuum within the furnace 10 occurs a minimum of two times and may be practiced for one or more additional cycles. It will be appreciated that by cycling the hydrogen gas and vacuum, fresh hydrogen is introduced into regions, i.e., tight surface cracks in the component which may have been poorly cleaned during a previous cycle due to depletion of the hydrogen gas in the crack region. That is, to the extent the hydrogen gas becomes stagnant in any cracks and hence becomes ineffective for further reduction, those reaction products and hydrogen gas are removed by the application of the vacuum. Fresh hydrogen is then introduced in the next cycle to react with the residual or remaining contaminants on the metallic surfaces or in the cracks.

Subsequent to the repetitive cycling of the hydrogen gas and vacuum within the furnace 10, and following the last of the evacuations of the furnace to the preferred one micron or below vacuum level, the furnace is cooled to below 250° F. under vacuum or by flowing an inert gas via inlet 26 and valve 28 into the furnace. The inert gas can be assisted by a fan and a heat exchanger, if necessary. Upon cooling, the cleaned surfaces of the metallic component can be repaired, for example, by utilizing an ADH process which includes applying a powdered metal to the surface and heating the metal in part to a molten state whereby the metal wets the clean surface and adheres thereto and fills the clean cracks.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of cleaning surfaces and surface cracks on a metallic article, comprising the steps of:

(a) disposing the article within a vacuum furnace;

(b) heating the article to a temperature of about 1400° F. or above within the vacuum furnace; and (c) repetitively cycling hydrogen gas and a vacuum within the furnace by supplying in each cycle a fresh supply of hydrogen gas within the furnace at a pressure within a range of about 500-10,000 microns, followed by removal of reaction products resulting from a reaction between hydrogen gas and surface contaminants on the article and substantially all residual hydrogen gas from within the furnace.

2. A method according to claim 1 including evacuating the furnace to a vacuum pressure of about 50 microns or less.

3. A method according to claim 1 including evacuating the furnace to a vacuum pressure of about 1 micron or less.

4. A method according to claim 1 including providing the hydrogen gas within the furnace at a pressure within a range of about 6000-9000 microns.

5. A method according to claim 1 including, subsequent to step (c), cooling the article under an inert gas.

6. A method according to claim 1 including maintaining the hydrogen gas in each cycle for a time period of between about ten minutes and four hours.

7. A method according to claim 1 including maintaining the hydrogen gas in each cycle for a time period of between about thirty minutes and sixty minutes.

8. A method according to claim 4 including evacuating the furnace to a vacuum pressure of about 50 microns or less.

9. A method according to claim 4 including evacuating the furnace to a vacuum pressure of about 1 micron or less.

10. A method according to claim 5 including, subsequent to step (c), removing the cleaned article from the furnace and applying a filler of a molten metal to the surface cleaned by steps (a)-(c).

11. A method of refurbishing surfaces on a turbine component formed of a cobalt based alloy wherein the surfaces include oxide contaminants, comprising the steps of:

(a) disposing the turbine component within a vacuum furnace;

(b) heating the turbine component to a temperature of about 1400° F. or above within the vacuum furnace;

(c) repetitively cycling hydrogen gas and a vacuum within the furnace by supplying in each cycle a fresh supply of hydrogen gas within the furnace at a pressure within a range of about 500-10,000 microns, followed by removal of reaction products resulting from a reaction between the hydrogen gas and surface oxides on the article and substantially all of any residual hydrogen gas from within the furnace; and (d) adhering a molten metal to the cleaned surface of the turbine component subsequent to step (c) to refurbish the surface.

12. A method according to claim 11 including providing the hydrogen gas within the furnace at a pressure within a range of about 6000-9000 microns and evacuating the furnace to a vacuum pressure of about 50 microns, or less.

13. A method according to claim 11 including providing the hydrogen gas within the furnace at a pressure within a range of about 6000-9000 microns and evacuating the furnace to a vacuum pressure of about 1 micron or less.

14. A method according to claim 12 wherein the hydrogen gas pressure is maintained for a predetermined time and including heating the turbine component to a temperature of about 2200° F. and maintaining the pressure and said temperature for said predetermined time.

15. A method of cleaning surfaces and surface cracks on a metallic article, comprising the steps of:

(a) disposing the article in a vacuum furnace;

(b) evacuating the furnace;

(c) heating the article in the vacuum furnace to a temperature of about 1400° F.;

(d) in a first cycle, introducing hydrogen gas at a pressure within the range of about 6000-9000 microns into the furnace to obtain a partial pressure within the furnace;

(e) raising the temperature of the article within the furnace from said about 1400° F. to a predetermined temperature during said first cycle;

(f) holding said predetermined temperature of the article within the furnace for a predetermined time period during said first cycle;

(g) evacuating the furnace during said first cycle;

(h) in a second cycle following said first cycle, reintroducing hydrogen gas into the furnace to obtain the partial pressure within the furnace;

(i) raising the temperature of the article within the furnace to said predetermined temperature during said second cycle;

(j) holding said predetermined temperature of the article within the furnace for said predetermined time period during the second cycle; and (k) evacuating the furnace during the second cycle to thereby remove reaction products resulting from a reaction between hydrogen gas and surface contaminants on the article and substantially all residual hydrogen gas from within the furnace.

16. A method according to claim 15 wherein steps (b) and (g) include evacuating the furnace to a vacuum level of about 1 micron or below.

17. A method according to claim 15 wherein steps (e) and (i) include raising the temperature of the article within the furnace to the predetermined temperature of about 1800° F. or higher.

18. A method according to claim 15 wherein steps (e) and (i) include raising the temperature of the article within the furnace to the predetermined temperature of about 2200° F.

19. A method according to claim 15 wherein steps (f) and (j) include holding said predetermined temperature of the article within the furnace for a period of between 0.5-1 hour.

20. A method according to claim 15 including, subsequent to step (k), cooling the article within the furnace under an inert gas.

21. A method according to claim 15 wherein steps (a) through (k) are performed in sequence and, following step (k) and in a third cycle, reintroducing hydrogen gas into the furnace to obtain the partial pressure within the furnace, raising the temperature of the article within the furnace to said predetermined temperature, holding said predetermined temperature of the article within the furnace for said predetermined time period and evacuating the furnace.

22. A method according to claim 15 wherein steps (b) and (g) include evacuating the furnace to a vacuum level of about 1 micron or below, steps (e) and (i) include raising the temperature of the article within the furnace to said predetermined temperature of about 2200° F. and steps (f) and (j) include holding said predetermined temperature of the article within the furnace for a period of at least about 0.5-1 hour.

* * * * *